United States Patent [19]

Broussard

[11] Patent Number: 4,768,531

[45] Date of Patent: Sep. 6, 1988

[54] PORTABLE FIRST-AID GROOMER

[76] Inventor: Alphe Broussard, 64 Avenue Mohamed Diouri, Kenitra, Morocco

[21] Appl. No.: 509,601

[22] Filed: Jun. 30, 1983

[51] Int. Cl.[4] ..... A45D 44/18

[52] U.S. Cl. ..... 132/84 C; 132/84 R

[58] Field of Search ..... 132/84 R, 84 B, 84 C; 30/26-28; 362/157, 118-120, 171, 202-203; 15/105; 240/10.68; 128/9

[56] References Cited

U.S. PATENT DOCUMENTS

| | | | |
|---|---|---|---|
| 1,066,839 | 7/1913 | Pettibone | 30/28 |
| 1,449,165 | 3/1923 | Cameron | 362/120 |
| 1,813,359 | 7/1931 | Priest | 132/84 B |
| 1,847,495 | 3/1932 | Priest | 132/84 A |
| 1,853,453 | 4/1932 | Priest | 132/84 A |
| 2,164,148 | 6/1939 | Swanson | 362/203 |
| 2,588,559 | 3/1952 | Needham | 362/202 |
| 2,634,025 | 4/1953 | Hausner | 132/84 R |
| 3,261,978 | 7/1966 | Brenman | 15/105 |

FOREIGN PATENT DOCUMENTS

| | | | |
|---|---|---|---|
| Ad.15008 | 6/1897 | United Kingdom | 132/84 A |

*Primary Examiner*—Richard J. Apley
*Assistant Examiner*—Robert Bahr
*Attorney, Agent, or Firm*—Fisher, Christen & Sabol

[57] ABSTRACT

Portable device for dental care and grooming which includes an elongated member which has a passageway therein extending essentially the entire length thereof, the first end of the passageway is open and the second end is closed. A flashlight arrangement is positioned in the passageway. The light bulb of the flashlight is located in the open end of the passageway. A toothbrush or other utilitarian device is removably attached to the end of the elongated member opposite of the end thereof containing the light bulb. There is an elongated cover which has a passageway therein extending all or most of the entire length thereof. The cover fits over the toothbrush and detachably onto the end of the elongated member. The first end of the passageway is open and the second end is closed.

5 Claims, 5 Drawing Sheets

FIG. 18

<table>
<tr><td colspan="3">PEN REFILLER SPARES</td><td>TOOTH BRUSH SPARE</td></tr>
<tr><td>VICKS INHALER SPARE</td><td>WAX STICK SPARE</td><td>LENS SPARE</td><td>ALOE VERA STICK SPAN</td></tr>
<tr><td>ETC.</td><td colspan="2">BATTERY SPARE</td><td>ETC.</td></tr>
<tr><td>ETC.</td><td colspan="2">ETC.</td><td>SEWING KIT</td></tr>
<tr><td colspan="4">GROOMER SET</td></tr>
</table>

PORTABLE FIRST-AID GROOMER

FIELD OF THE INVENTION

The invention relates to portable devices for first aid, grooming and/or dental care.

BROAD DESCRIPTION OF THE INVENTION

An object of the invention is to provide portable devices which combine at least two capabilities of first aid, grooming, dental care and the like. Other objects and advantages of the invention are set out herein or are obvious herefrom to one ordinarily skilled in the art.

The objects and advantages of the invention are achieved by the devices of the invention.

The invention involves a portable device for dental care and grooming which includes an elongated member which has a passageway therein extending essentially the entire length thereof. The first end of the passageway is open and the second end is closed. A flashlight device is positioned in the passageway. The light bulb of the flashlight is located in the first end of the passageway. A toothbrush or other utilitarian device is removably attached to the end of the elongated member opposite of the end thereof containing the light bulb. There is an elongated cover which has a passageway therein extending all or most of the entire length thereof. The cover fits over the toothbrush and detachably onto the end of the elongated member. The first end of the passageway is open and the second end is closed. Preferably the elongated cover contains at least one hole therein near the toothbrush when the elongated cover is affixed onto the elongated member. Also preferably a magnifying glass is mounted on the end of the elongated member having the light bulb. Preferably the elongated cover contains in the second end thereof a chamber in which the magnifying glass is stored. The chamber preferably contains a cap on its second end.

The invention involves a portable device having a pen and for grooming, first aid or the like which includes an elongated member which has a passageway therein extending essentially the entire length thereof. The first end of the passageway is open and the second end is closed. An ink pen device is positioned in the passageway. The ink-writing tip or point of the pen is located in the first end of the passageway and is extendable into and out of the first end of the passageway. A first aid, grooming or other utilitarian device removably attached to the end of the elongated member opposite of the end thereof containing the pen tip. There is an elongated cover which has a passageway therein extending all or most of the entire length thereof. The cover fits over the first aid or grooming device and detachably onto the end of the elongated member. The first end of the passageway is open and the second end is closed.

Preferably the elongated cover contains at least one hole therein near the affixed onto the elongated member. Also preferably the elongated cover contains in the second end thereof a chamber in which a finger nail clipper is mounted. The chamber preferably contains a cap.

BRIEF DESCRIPTION OF THE DRAWINGS

In the drawings:

FIG. 18 is a market fit for attachments for the invention devices.

DETAILED DESCRIPTION OF THE INVENTION

Figure 1:
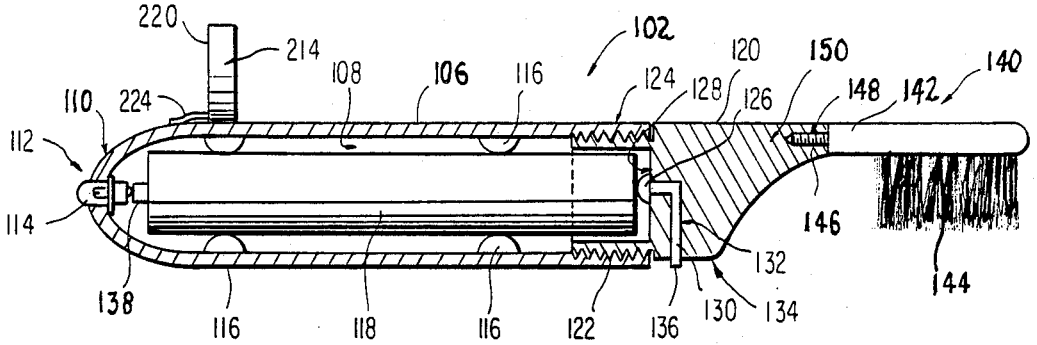
FIG. 1 is a side elevational view, partially cutaway, of the main body of the portable device of the invention for dental care and grooming.
Figure 2:
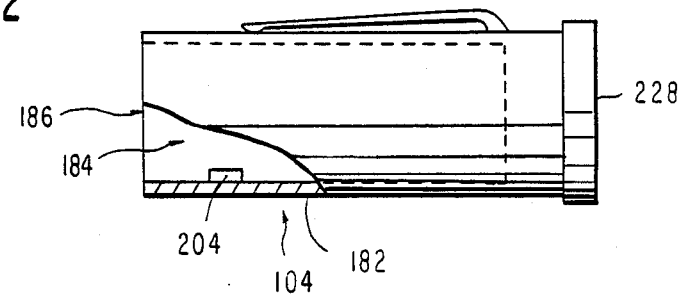
FIG. 2 is a side elevational view of the detachable cover of the portable device of FIG. 1.

Portable device 100 contains main body 102 (shown in FIG. 1) and detachable cover 104 (shown in FIG. 2). Main casing 106 is hollow (having passageway 108) and has bullet-shaped nose 110 with aperture 112 therein. Pen light bulb (flashlight bulb) 114 protrudes through aperture 112. Rubber nipples 116 hold flashlight battery 118 in chamber 108 in a tight but movable manner. Each bank of nipples 116 usually has three or four nipples 116 spaced equally in distance around chamber 108. Nipples 116 can be hard or resilient, but preferably are resilient. Cap portion 120 contains lower hollow portion 122, which is externally threaded. The other end (124) of main casing 106 is internally threaded. The bottom of battery 118 contacts nipple 126, which is constructed of an electrically conductive metal, such as steel, copper or aluminum. Nipple 126 is positioned on inner face 128 of cap portion 120 and is the end of wire or flat sheet 130. Flat sheet 130 is contructed of an electrically conductive metal, such as steel, aluminium or copper. Flat sheet 130 is L-shaped and fits in L-shaped passageway 132 of cap portion 120. Side wall 134 of cap portion 120 is lower than the outside of end 124 of casing 106. End 136 of flat sheet 130 extends radially outwardly out of passageway 132 about as far as end 124 of casing 106. Casing 106 is contructed of a conductive metal, such as steel, aluminum or copper. Top 138 of battery contacts the bottom of light bulb 114.

Figure 3:
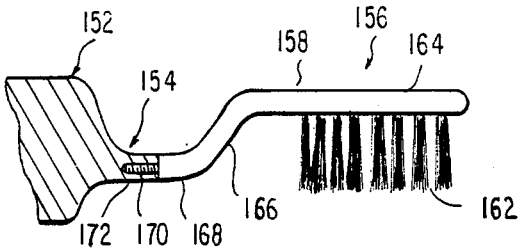
FIG. 3 is a partial side elevational view of one version of the device of FIG. 1.

Toothbrush 140 contains arm 142 and bristles 144, which are preferably nylon. Threaded portion 146 on the end of arm 142 threadingly engages internally threaded passageway 148 in arm 150 of cap portion 120. Arm 150 (in FIG. 1) is located at the outer perimeter of cap portion 120. FIG. 3 shows another embodiment of the toothbrush arrangement, although the toothbrush arrangement in FIG. 1 is preferred. In FIG. 3, cap portion 152 has arm 154 which is located on the central axis of main body 102. Toothbrush 156 contains arm 158 and bristles 160. Arm 158 has outer arm portion 164, which is aligned with the outer perimeter of cap portion 152, curved arm portion 166 and inner arm portion 168. Threaded portion 170 on the end of the inner arm portion 168 threadingly engages internally threaded passageway 172 in arm 152 of cap portion 152.

Figure 4:
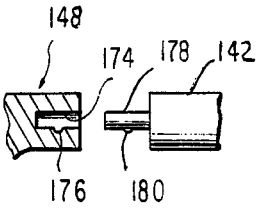
FIG. 4 is a partial view of an alternative way of detachably mounting the attachment of the device of FIG. 1.

Another method of attaching toothbrush 140 to cap portion 120 is shown in FIG. 4. Arm 148 of cap portion 120 contains passageway 174, which has small depression 176 located on the wall thereof. Short arm 178 of arm 142 of toothbrush 140 fits into passageway 174 in a tight but removable manner. Small nipple 180 on short arm 178 matingly engages depression 176 so as to assist in detachably affixing toothbrush 120 to cap portion 140. Passageway 174 and short arm 178 can have any matching cross-section, such as circular, triangular, square, etc. Depression 176 and nipple 180 are not required to keep toothbrush 140 from turning in relation to cap portion 120 as long as the cross-sections of passageway 176 and short arm 178 are not circular. Preferably passageway 174 and short arm 178 are both triangular in cross-section, are tightly fit and do not contain depression 176 and nipple 180, respectively.

Figure 8:
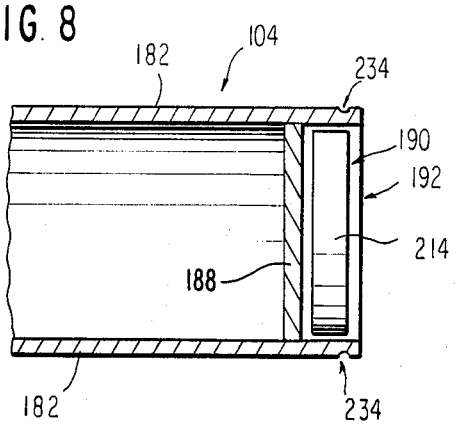
FIG. 8 is a side elevational view, partially cutaway, of the magnifying glass stored in the top compartment of the cover of the device of FIG. 1.

Referring to FIG. 2, detachable cover 104 has casing 182, which is hollow (having passageway 184 therein). The bottom end of casing 182 has aperture 186. Passageway 184 ends at wall 188—see FIG. 8. Wall 188 forms chamber 190 which opens through aperture 192.

Figure 9:
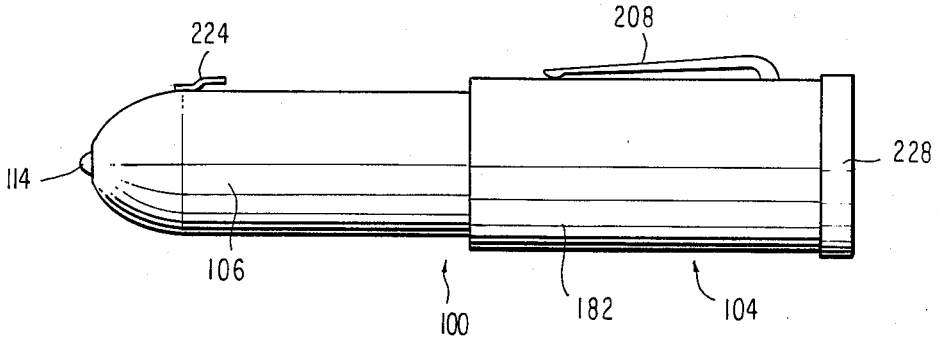
FIG. 9 is a side elevational view of the assembled portable device of FIGS. 1 and 2.

Shell 182 is constructed of an electrically conductive metal, such as steel, aluminum or copper. Pin 204 is mounted on the inside of shell 182 and is constructed of an electrically conductive metal, such as steel, aluminum or copper. When cover 104 is in place on main body as shown in FIG. 9, cover 104 can be turned to contact end 136 of flat sheet 130 which provides an electrical circuit that lights light bulb 114. Lightbulb 114 can be turned off by turning cover 104 to break the contact between pin 204 and end 136. Markings on the outside of cover 104 and shell 106 can be used to help align pin 204 and 136 in a close proximity.

Figure 5:
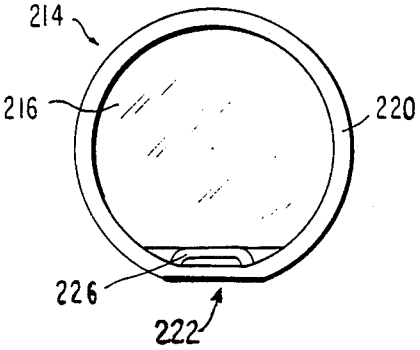
FIG. 5 is a front elevational view of the magnifying glass used with the device of FIG. 1.
Figure 6:
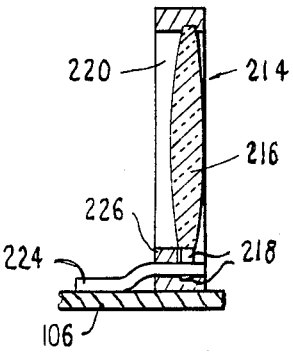
FIG. 6 is a cross-sectional side view of the magnifying glass mounted on the device of FIG. 1 (partially shown)
Figure 7:
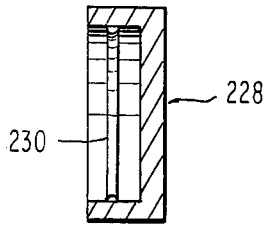
FIG. 7 is a cross-sectional view of the cap used on the cover of the device of FIG. 1.

Magnifying glass device 214 has magnifying glass 216 mounted in slot 218 on the back area of the inner surface of rim 220. The lower end of magnifying glass 216 has removed—see FIGS. 5 and 6. The lower side of rim 220 has concave portion 222 so that magnifying glass device 214 stably fits on the top of shell 106 as shown in FIGS. 1 and 6. Spring clip 224 is affixed on the top, front portion of shell 106 as shown in FIG. 1. The free end of spring clip 224 fits into and through C-loop member 226 as shown in FIG. 6. The mounting of clip member 226 in the bottom inside of rim 220 is best seen in FIG. 5.

When magnifying glass device 214 is mounted on the front of main body 102, light 114 and magnifying glass device 214 can be used to examine the teeth of a person or, with the aid of a mirror, to examine one's own teeth.

End cap 228 fits tightly, but detachably, on the end of main body 104 away from light bulb 114. Protrusion 230 is located on the inside of cap 228 near its lower rim. The end of casing 182 which contains depression 234 around its outer side. When cap 228 is placed on the end of casing 182, protrusion 230 fits in depression 232.

As shown in FIGS. 1 and 2, main body 102 (i.e., casing 106 and cap 120) and detachable cover or cap 104 have a circular cross-section, but can have any cross-section, such as hexagonal, square, octagonal or oblong.

Unless otherwise stated herein or obvious herefrom, the various parts of the invention embodiments can be constructed of any suitable material, such as plastic or metal or of any material(s) conventionally used for such part(s).

Figure 10:
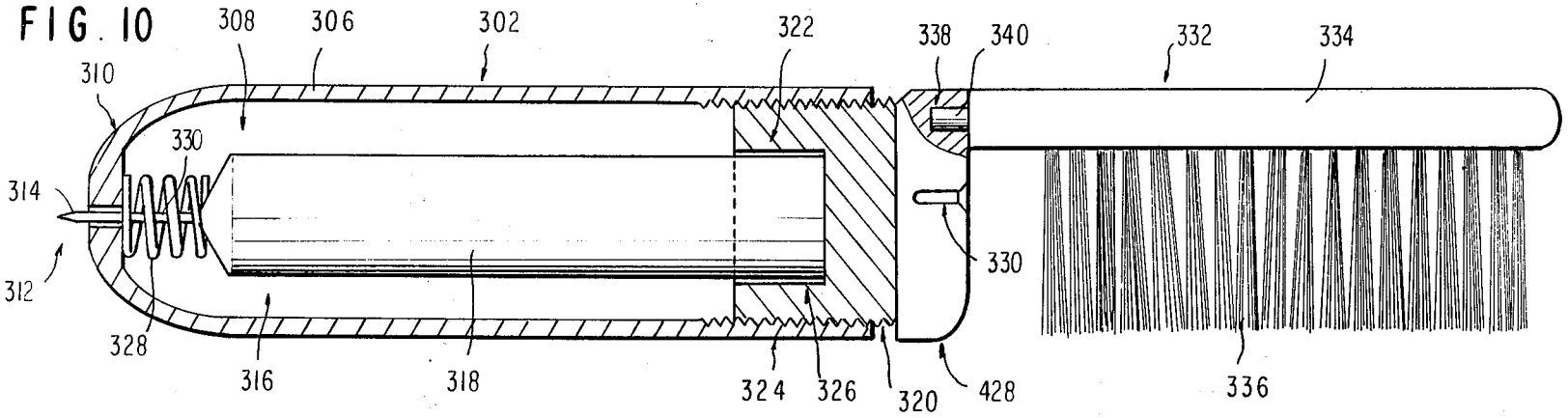
FIG. 10 is a side elevational view, partially cutaway, of the main body of the portable device of the invention having a pen and an attachment.
Figure 11:
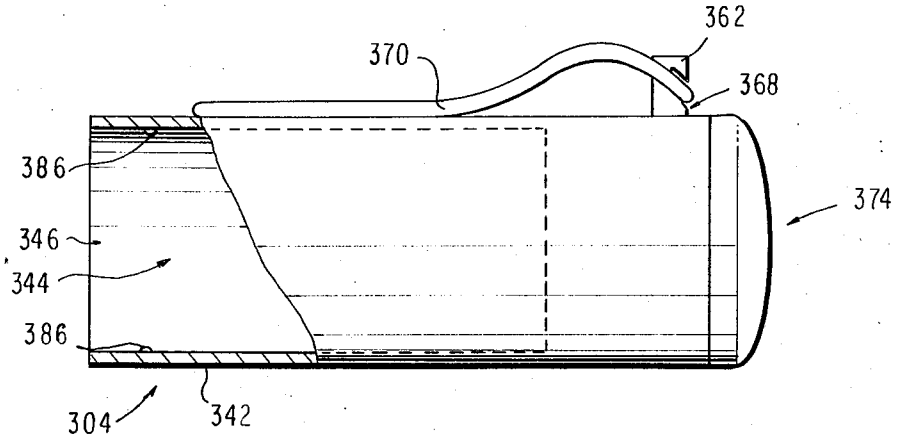
FIG. 11 is a side elevational view of the detachable cover of the portable device of FIG. 10.

Portable device 300 contains main body 302 (shown in FIG. 10) and detachable cover 304 (shown in FIG. 11). Main casing 306 is hollow (having passageway 308) and has bullet-shaped nose 310 with aperture 312 therein. Pen tips 314 of ball point pen 316 protrudes through aperture 312. Ball point pen also has ink-reservoir 318, which is located in chamber 308. Cap portion 320 contains lower hollow portion 322, which is externally threaded. The other end (324) of main casing 306 is internally threaded. The upper end of ink-reservoir fits, without too much clearance, in chamber 326 in lower portion 322 of cap portion 320. Coil spring 328 is located in the front end of chamber around pen tip shaft 330. Coil spring 328 keeps the end of ink-reservoir 318 firmly against the top of chamber 326. When cap portion 320 is screwed in or out of end portion 324 of main body 302, the end of ink-reservoir 318 slides on the top of chamber 326 so as not to cause any significant twisting of coil spring 328 or rotation of ink pen 316. Cap portion contains expanded or head portion 328, which has two diametrically-positioned vertical grooves 330 with expanded V-shaped throats. Most of the parts of main body 302, such as casing 306 and cap portion 320, are preferably constructed of a durable, break-resistant plastic but can be made of any suitable material, such as one of the metals.

Clothing or utility brush 332 contains arm 334 and bristles 336. Hole 338 is located in head portion 428, preferably is triangular in shape but can have any cross-section, such as circular, rectangular or square. Hole 338 may contain a small depression in the wall thereof. The inner arm portion of brush arm 334 has short arm 340 that fits into hole 338 in head portion 428. Short arm 340 preferably is triangular in shape but can have any cross-section, such as circular, rectangular or square. Short arm 340 can have a small nipple thereon which matingly engages such depression so as to assist in detachably affixing brush 332 to head portion 428. Such depression and nipple are not required to keep brush 332 from turning in relation to cap portion 320 as long as the cross-sections of hole 338 and short arm 340 are not circular. While not preferred, short arm 340 can be circular and externally threaded and hole 338 can be circular and internally threaded. When a screw-in arrangement is used, the parts need to be machined or formed with precision or a stop has to be placed on the short arm 340 in hole 338 to insure that brush 332 is not out of line with main body 302.

Figure 12:
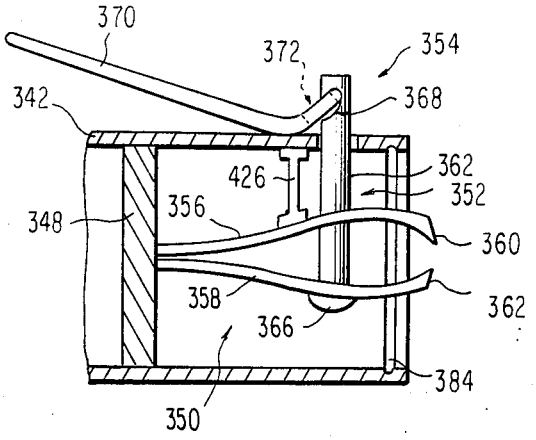
FIG. 12 is a side elevational view, partially cutaway, of the nail clipper located in the cover of the device of FIG. 10.
Figure 13:
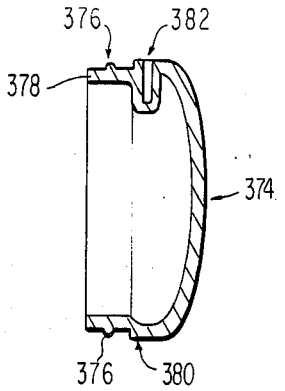
FIG. 13 is a cross-sectional view of the cap used on the cover of the device of FIG. 10.

Referring to FIG. 11, detachable cover 304 has casing 342, which is hollow (having passageway 344 therein). The bottom end of casing 342 has aperture 346. Passageway 344 ends at relatively thick wall 348—see FIG. 12. Wall 348 forms chamber 350 which opens through aperture 352. Nail clipper 354 includes curved, spring arms 356 and 358, which end in blades 360 and 362, respectively. Blades 360 and 362 are concave on the horizontal plane. The other end of blades 360 and 362 are affixed on wall 348, which is constructed of metal or other material of equal strength to support the stress caused by the use of nail clipper 354. Vertical pin 362 fits through a hole in arm 358, a hole in arm 356 and a hole in arm in the top of casing 342. Cap 366 is attached to the bottom of pin 362 shown in FIG. 12. The upper end of pin 362 contains slot 368 which is shaped like a hook. Curved arm 370 has hole 372 (see FIG. 12) which allows the end of arm 370 to pivot in the top of slot 368 from the rest position (see FIG. 11) to the lever position (see FIG. 12). When in the lever position, pressure on the end of arm 370 causes blade 362 of arm 358 to be moved towards and contact blade 362 of arm 358 (so as to cut a finger or toe nail). Pin 426 helps prevent the upward deformation or movement of arm 356.

End cap 374 fits tightly, but detachably on the end of main body 302 away from pen tip 314. End cap is deep enough so that the ends of arms 356 and 358 do not contact it. Protrusion 376 is located on the outside of the lower rim 378 of cap 374. Lower rim 378 is diminished in diameter from main rim 380 of cap 374. Flat hole 382 in main rim 380 is used to remove end cap 374 from cover 304. The end of casing 342 contains depression 384 arount it inner side. When cap 374 is placed on the end of casing 342, protrusion 376 fits in depression 384.

Figure 14:
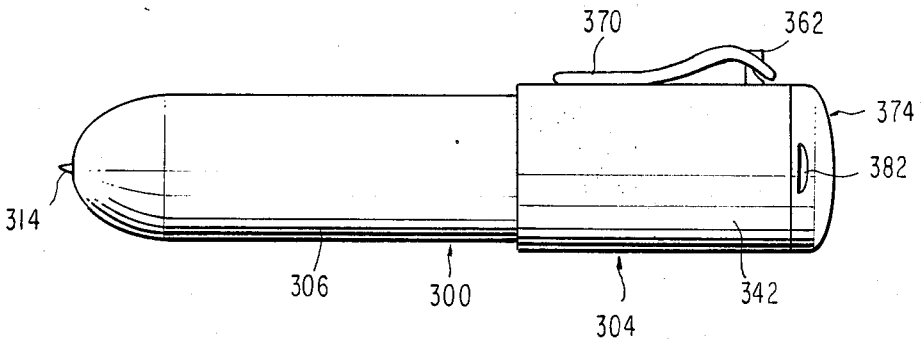
FIG. 14 is a side elevational view of the assembled portable device of FIGS. 10 and 11.

Any number of slots 330 (see FIGS. 15 to 17) can be used. A corresponding number of nipples 386 are located on the inside of the lower portion of shell 342 of cover 304. Nipples 386 fit into slots 330 when cover 304 is placed on main body 302 (enclosing brush 332). Referring to FIGS. 10 and 14, when cover 304 is in place, it can be turned to cause ballpoint pen tip 314 to move in or out of aperture 312. Marks on the outside of cover 304 and main body 302 can be used to assist in aligning nipples 386 with slots 330.

As shown in FIGS. 10 and 11, main body 302 (i.e., casing 306 and cap 320) and detachable cover or cap 304 have a circular cross-section, but can have any cross-section, such as hexagonal, square, octagonal or oblong.

Figure 15:
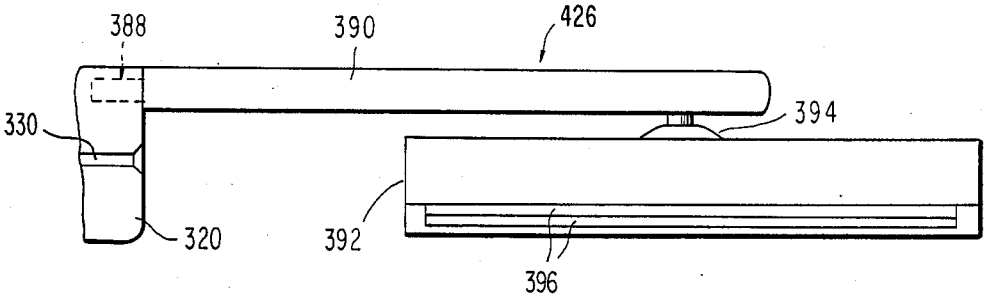
FIG. 15 is a side elevational view of a razor attachment for the device of FIG. 10.

FIG. 15 shows razor attachment 426 for detachable mounting in cap portion 320 by means of short arm 388 at the end of arm 390. Conventional double bladed razor head 392 is pivotally mounted on the end portion of arm 390 by means of pivot 394. Numeral 396 indicates the two razor blades. Razor head 392 is shown in the storage position in FIG. 15, but in use it is pivoted 90 degrees clockwise to be in the shaving position. Pivot means has lock positions at the storage and use positions.

Figure 16:
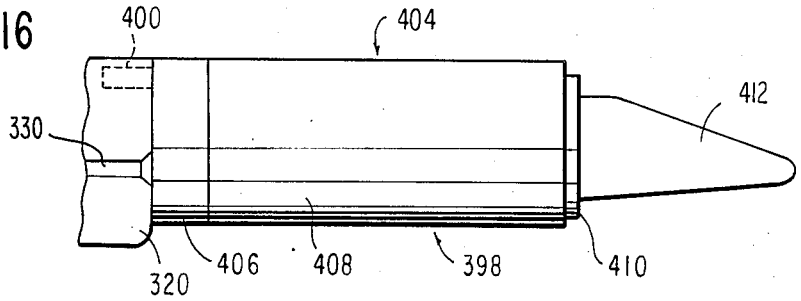
FIG. 16 is a side elevational view of a lip stick attachment for the device of FIG. 10.

FIG. 16 shows lip stick attachment 398 for detachable mounting in cap portion 320 by means of short arm 400. Container 404 can be a conventional lip stick container which is capable of accepting replacement sticks of lip stick or the like. Container 404 includes bottom casing 406, turning grip 408, inner casing 410 and lip stick 412.

Figure 17:
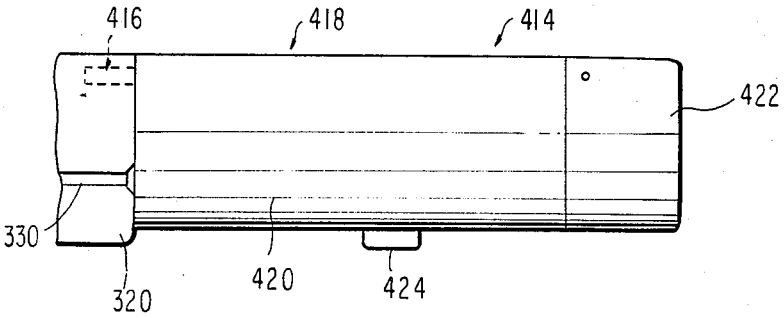
FIG. 17 is a side elevational view of a lighter attachment for the device of FIG. 10.

FIG. 17 shows lighter attachment 414 for detachable mounting in cap 320 by means of short arm 416 mounted on the bottom of lighter 418. Lighter 418 is a conventional cigarette lighter having casing 420, pivotal top 422 and a file-movement spark producing element, the handle (422) of which is shown. The handle (424) is used to move the file by thumb action.

The changeable brush 140 is small, fine and soft, and is made of nylon bristles which are set in rows to get in between the teeth and way back in the mouth.

Device 300 shown in FIG. 15 is for men, having a razor and a ball pen which is driven in and out by twisting the cap. The razor blade can be a changeable GII blade. FIG. 16 shows device 300 for women, having a tube of lip stick and a ball pen which is driven in and out by twisting the cap. The tube of lip stick is also changeable or of the refill type. Brush 332 can be replaced by a comb, so then device 300 would be for children, having a comb and a ball pen. The comb is also changeable.

The invention device does not diminish the function of a pen set since it still has a ball pen to write with when the necessity arrises. The invention device has simply added a few conveniences and advantages in a vital limited space.

One can clean one's smile, teeth and mouth the natural way with the invention groomer and water from the facet wherever one is located. One can rinse and brush one's teeth to remove residue foods in particularly sugary foods to limit exposure after each meal, for esthetic of the smile, to guard against unpleasant mouth odors, to massage and strengthen the connective gum tissues which holds the teeth and to help prevent infectious diseases. The invention groomer automatically eliminates the need for dental toothpaste which normally contain abrasives, additives, preservatives, artificial coloring and artificial flavoring which are supposedly detremental to one's health when absorbed. To file down the enamel of one's teeth by hard brushing is not recommended nor is it necessary wherever one is at the time.

FIG. 18 shows a marketing kit which can be used with the invention devices, being sold in places, such as natural food stores and drug stores. The kit can be tailored in content for men, women or children. The kit allows the user to always have a spare item. The kit could contain a replacement toothbrush, razor, Vick's inhaler, retractable glue sticker, toothpaste tube, sewing spindel (and needles), comb, lighter and replacement sticks, such as lip stick, *Aloe vera* stick, septic stick, First Aid stick and wax stick, for use in the lip stick attachment. The Aloe Vera stick could be in a soft form.

The invention groomer helps insure and facilitate the cleaning of the mouth, the teeth and the smile after each meal. It helps eliminate the need for dental toothpaste which normally contain abrasives, additives, preservatives, artificial coloring and artificial flavoring which are supposedly detremental to your health when absorbed. By providing one's body with the necessary nutrients and by eliminating the elements which diminish good general health, one can help one's defense mechanism to prevent diseases of the mouth, the gums, the teeth and the body since many things including digestion start in the mouth. There is a savings in pain, tooth decay, dental work, and work stoppage.

The invention groomer, having the likeness of a pen set, comes in sets for men, women and children. The primary function of the groomer is to clean the mouth and the teeth in order to prevent diseases of the mouth, the gums, the teeth and the body. Another embodiment conveniently assembles a razor, lip stick, nail clipper, comb, pen light, cigarette lighter and ball pen to accommodate men and women, young or old. For men, the invention groomer can be equipped with a toothbrush and a pen light. The second piece can have a razor, a ball pen and a nail clipper. For women, the invention groomer can be equipped with a toothbrush and pen light. The second piece can have a tube of lip stick, a ball pen and a nail clipper. For children, the invention groomer can have a toothbrush and a pen light. The second piece can have a comb, a ball pen and a nail clipper. The various tools are exposed by removing the respective caps which show the nail clipper at the end of the holding clamp of the second piece.

The invention groomer is a compact unit consisting of a toothbrush, a pen light, a magnifying lens, a razor, a tube of lip stick, a ball pen, a comb and/or a nail clipper, which can be housed several at a time in a set with the likeness of a pen set designed to serve men, women or children as applicable. The cigarette lighter which may be substituted in the second embodiment device for the razor, tube of lip stick or comb for smokers, as desired. In a dispenser mechanism similar to the tube of lip stick, a first aid refill, such as Aloe Vera, wax, glue, sewing kit, toothpaste, if desired and others may be substituted in any of the second embodiment devices as appropriate.

What I claim is:

1. A portable device for illumination, dental care and grooming comprising in combination:

(a) an elongated member, adapted for use as a handle, having a passageway therein extending along the length of said elongated member, a first end of the passageway being adjacent to a first end of the elongated member and being open, and the second end of the passageway being closed; said elongated member having a light bulb in said open first end of the passageway, and an electric battery being located in said passageway having one terminal thereof in contact with said light bulb; said electric battery being adapted to energize said light bulb to generate light; said closed second end having a conductor of electricity located in said second end adapted to be in abutting electrical contact with said electric battery; said elongated member including an electrical conductor for contacting a conductive portion of said light bulb;

(b) a utilitarian attachment unit selected from the group consisting of a toothbrush attachment, a razor attachment, a lighter attachment, a brush attachment, a retractable wax stick attachment, a medical inhaler attachment, a retractable aloe-vera stick, a comb attachment, a toothpaste tube attachment, a retractable glue sticker attachment, a retractable septic stick attachment, a retractable first aid stick attachment, a retractable lip stick attachment, and a sewing spindle attachment, which is adapted to be manipulated, being removably attached to a second end of said elongated member which is located opposite of said first end of said elongated member, and (c) an elongated cover having a passageway therein extending along the length of said elongated cover and which has an end which is adapted to enclose the utilitarian attachment unit; said elongated cover being detachably attached onto said second end of said elongated member; said elongated cover having a means for closing an electrical circuit between said light bulb and said electrical battery; said means for closing, including an electrically-conductive member fixedly attached to said passageway in said elongated cover, which is adapted to be rotated with said cover into selective-electrical connection to close said electrical circuit;

whereby said elongated cover, when attached to second end of said elongated member, protects the utilitarian device from damage from the outside environment, and to selectively open or close the circuit to energize the light bulb by rotation relative to said elongated member; said elongated member being usable as a handle for carrying and manipulating said utilitarian device.

2. The portable device for illumination, dental care and grooming as claimed in claim 1 wherein said elongated cover has a receptacle located therein at the end enclosing said passageway in said elongated cover and further comprising a magnifying glass; said receptacle being adapted to receive said magnifying glass therein; said receptacle having a detachable cover adapted to selectively enclose the receptacle; said magnifying glass being selectively mountable to said elongated member by a mount located on the end of the elongated member having the lightbulb.

3. A portable device for illumination, dental care and grooming comprising in combination:

(a) an elongated member, adapted for use as a handle, having a passageway therein extending along the length of said elongated member, a first end of the passageway being adjacent to a first end of the elongated member and being open, and a second end of the passageway being closed, said elongated member having a light bulb in said open first end of the passageway; and an electric battery being located in said passageway having one terminal thereof in contact with said light bulb, said electric battery being adapted to energize said light bulb to generate light; said closed second end having a conductor of electricity located at said second end adapted to be in abutting electrical contact with said electric battery; said elongated member including an electrical conductor for contacting a conductive portion of said light bulb;

(b) a utilitarian device which is adapted to be manipulated, being removably attached to a second end of said elongated member which is located opposite of said first end of said elongated member; and (c) an elongated cover having a passageway therein extending along the length thereof and which has an end which is adapted to enclose the utilitarian device, said elongated cover being detachably attached onto said second end of said elongated member, said elongated cover having a means for closing an electrical circuit between said light bulb and said electric battery, said means for closing including an electrically conductive member fixedly attached to said passageway in said elongated cover which is adapted to be rotated with said cover into selective electrical connection to close said electrical circuit;

whereby said elongated cover, when attached to said second end of said electrical member, serves to protect the utilitarian device from damage from the outside environment, and to selectively open or close the circuit to energize the light bulb by rotation relative to said elongated member; said elongated member being usable as a handle for carrying and manipulating said utilitarian device.

4. The portable device for illumination, dental care and grooming as claimed in claim 3 wherein said elongated cover has a receptacle located therein at the end enclosing said passageway in said elongated cover and further comprising a magnifying glass; said receptacle being adapted to receive said magnifying glass therein; said receptacle having a detachable cover adapted to selectively enclose the receptacle; said magnifying glass being selectively mountable to said elongated member by a mount located on the end of the elongated member having the lightbulb.

5. The portable device for illumination, dental care, and grooming, as claimed in claim 1, wherein the utilitarian device is a toothbrush attachment.

* * * * *